US009929509B1

(12) United States Patent
Penn et al.

(10) Patent No.: US 9,929,509 B1
(45) Date of Patent: Mar. 27, 2018

(54) CONNECTOR SYSTEM WITH LOW PROFILE CONNECTOR POSITION ASSURANCE DEVICE

(71) Applicant: Delphi Technologies, Inc., Troy, MI (US)

(72) Inventors: Matthew L. Penn, Cortland, OH (US); Geronimo Mauricio De la Torre, Warren, OH (US); Cory R. Ensley, Canfield, OH (US)

(73) Assignee: DELPHI TECHNOLOGIES, INC., Troy, MI (US)

( * ) Notice: Subject to any disclaimer, the term of this patent is extended or adjusted under 35 U.S.C. 154(b) by 0 days.

(21) Appl. No.: 15/619,985

(22) Filed: Jun. 12, 2017

(51) Int. Cl.
*H01R 13/627* (2006.01)
*H01R 13/639* (2006.01)

(52) U.S. Cl.
CPC ..... *H01R 13/639* (2013.01); *H01R 13/6275* (2013.01)

(58) Field of Classification Search
CPC ..... H01R 13/6271; H01R 13/6275
USPC ..... 439/352, 489
See application file for complete search history.

(56) References Cited

U.S. PATENT DOCUMENTS 4,634,204 A 1/1987 Detter et al.
5,026,298 A 6/1991 Brussalis et al.
5,605,471 A 2/1997 Plyler
5,624,271 A * 4/1997 Childs ..... H01R 13/6272 439/352
5,643,003 A 7/1997 Myer
5,651,689 A 7/1997 Plyler
5,681,178 A 10/1997 Kunkle et al.
5,688,142 A 11/1997 Dietz et al.
5,759,058 A 6/1998 Childs et al.
5,775,930 A 7/1998 Model et al.
6,012,945 A 1/2000 Tabor et al.
6,533,601 B2 3/2003 Raudenbush et al.
6,547,584 B2 4/2003 Myer et al.
6,896,538 B2 5/2005 Grubbs
6,921,279 B2 7/2005 Sian et al.
7,255,593 B2 8/2007 Tyler
7,326,074 B1 2/2008 Lim et al.
7,347,745 B1 3/2008 Raudenbush et al.
(Continued)

FOREIGN PATENT DOCUMENTS

WO 2006131141 A1 12/2006

*Primary Examiner* — Phuong Dinh
(74) *Attorney, Agent, or Firm* — Robert J. Myers

(57) ABSTRACT

A connector assembly including a first connector having a primary locking lever pivotably mounted to the first connector. The primary locking lever defines a pair of beams extending to a primary latch. The primary latch defines a ridge along a rearward edge providing a secondary striker. The second connector includes a primary striker that with the primary latch locks the first and second connectors together. The assembly further includes a CPA device slideably mounted to the first connector and a CPA lever defining a secondary latch. The secondary latch engages the lateral ridge to inhibit movement of the CPA device from an initial position to a final position until after the first and second connectors are fully mated. The secondary latch of the CPA device engages the secondary striker when the CPA device is moved to the final position, thereby preventing disengagement of the primary latch from the primary striker.

14 Claims, 8 Drawing Sheets

(56) References Cited

U.S. PATENT DOCUMENTS

| | | | | |
|---|---|---|---|---|
| 8,016,606 | B1 | 9/2011 | Kwan et al. | |
| 8,784,127 | B2 | 7/2014 | Bashkin et al. | |
| 8,926,355 | B2 | 1/2015 | Heil et al. | |
| 9,160,095 | B2 | 10/2015 | Littek et al. | |
| 9,362,676 | B2 | 6/2016 | Puhl et al. | |
| 9,490,576 | B2 | 11/2016 | Plazio et al. | |
| 9,608,369 | B1 | 3/2017 | Brandt et al. | |
| 2010/0233897 | A1 | 9/2010 | Seo et al. | |
| 2013/0143886 | A1* | 6/2013 | Lademacher | A61K 31/415<br>514/241 |

* cited by examiner

CONNECTOR SYSTEM WITH LOW PROFILE CONNECTOR POSITION ASSURANCE DEVICE

TECHNICAL FIELD OF THE INVENTION

The invention generally relates to a connector system configured to interconnect electrical cables, and more particularly relates to connector system which includes a low profile connector position assurance device.

BACKGROUND OF THE INVENTION

Coaxial cable connector assemblies have been used for numerous automotive applications, such as global positioning systems (GPS), infotainment systems, and air bag systems. Coaxial cables typically consist of an outer shield conductor, an inner center conductor, a dielectric, and an insulation jacket. The outer conductor and the inner conductor of the coaxial cable often electrically interface with a mating coaxial cable through socket and plug connectors. Such conventional coaxial cable connectors are known in the art.

In order to standardize various types of connectors and thereby avoid confusion, certain industry standards have been established. One of these standards is referred to as FAKRA. FAKRA is the Automotive Standards Committee in the German Institute for Standardization (in German "Deutsches Institut für Normung", best known by the acronym DIN), representing international standardization interests in the automotive field. The FAKRA standard provides a system, based on keying and color coding, for proper connector attachment. Like socket keys can only be connected to like plug keyways in FAKRA connectors. Secure positioning and locking of connector housings is facilitated by way of a FAKRA defined catch on the socket housing and a cooperating latch on the plug housing. The FAKRA standard is contained in the USCAR-18 standard published by the United States Council for Automotive Research (USCAR).

A locking mechanism is used when a first connector is mated to a second connector to secure the first and second connectors together. The first and second connectors are secured together to ensure that the connector system can withstand forces that would tend to pull the connectors apart and break the electrical connection between terminals in the connectors when mated to each other. The locking mechanism may include a latch on one connector that engages a striker of a mating connector when the two connectors are fully mated. Ensuring that the mated connectors in a respective connector system are fully mated to one another may avoid open circuits that occur when the connectors are not fully mated to each other. The connector system may be used in a complex manufactured product, such as an automobile. If the connectors in the connector system are not fully mated to each other during assembly of the automobile, an open circuit may be difficult to diagnose, locate, and repair. For example, it may be difficult to identify and access a faulty connection between two connectors in the automobile that includes hundreds or thousands of connections.

Due to physical characteristics such as small size and shielded conductors, it may be difficult to determine whether two mating connectors are properly mated together. For example, two connectors that are not fully mated to each other may only be a few millimeters from the fully mated positions of the connectors, which may be difficult for an assembler to identify. Therefore, a need remains for a connector system that provides assurance that two connectors are fully mated to each other in order to avoid errors caused by breaks in the conductive pathway defined by the connectors.

The subject matter discussed in the background section should not be assumed to be prior art merely as a result of its mention in the background section. Similarly, a problem mentioned in the background section or associated with the subject matter of the background section should not be assumed to have been previously recognized in the prior art. The subject matter in the background section merely represents different approaches, which in and of themselves may also be inventions.

BRIEF SUMMARY OF THE INVENTION

In accordance with an embodiment of the invention, a connector assembly is provided. The connector assembly includes a first connector having a primary locking lever pivotably mounted to the first connector. The primary locking lever defines a pair of beams extending generally parallel to one another along a mating axis to a primary latch mounted to the pair of beams. The primary latch defines a lateral ridge along a rearward edge providing a secondary striker. The connector assembly also includes a second connector that is configured to mate with the first connector along the mating axis. The second connector has a primary striker that is configured to engage the primary latch so as to lock the first connector and the second connector together when the first connector and the second connector are mated. The connector assembly further includes a connector position assurance (CPA) device movable from an initial position to a final position only when the first connector and the second connector are mated. The CPA device has a base that is slideably mounted to the first connector and a CPA lever defining a secondary latch extending from the base. The secondary latch engages the lateral ridge to inhibit movement of the CPA device from the initial position to the final position until after the first connector and the second connector are mated. The secondary latch of the CPA device is configured to engage the secondary striker when the CPA device is in the final position, thereby preventing disengagement of the primary latch from the primary striker.

The pair of beams may define a slit between then and the CPA lever may be at least partially disposed within this slit. The CPA lever may define a lateral flange that extends laterally on each side of the CPA lever. The lateral flange is configured to engage the pair of beams, thereby maintaining engagement of the secondary latch with the lateral ridge until the first connector and the second connector are mated.

The secondary latch of the CPA device may be located intermediate the secondary striker a wall of the first connector when the CPA device is in the final position, thereby inhibiting vertical movement of the secondary latch and inhibiting release of the primary latch from the primary striker. The wall may be spaced apart from the first connector. The base may be configured such that it does not extend beyond this wall.

The base of the CPA device may be characterized has having a generally trapezoidal prism shape with a trapezoidal forward surface and a trapezoidal rearward surface. The rearward surface of the base may define a first plurality of lateral protrusions providing a push surface configured for moving the CPA device from the initial position to the final position. The forward surface of the base may define a second plurality of lateral protrusions providing a pull surface configured for moving the CPA device from the final position to the initial position. Alternatively, the forward surface of the base may define an indentation providing pull surface configured for moving the CPA device from the final position to the initial position.

The first connector and the second connector may conform to the USCAR-18 standards. An electrical terminal disposed within the first connector and an electrical wire cable attached to said electrical terminal may have a straight orientation between them. Alternatively, an electrical terminal disposed within the first connector and an electrical wire cable attached to said electrical terminal have a right-angled orientation between them. In the latter case, the base does not contact the electrical wire cable when the CPA device is in the initial position regardless of the rotational orientation of the cable relative to the first connector.

BRIEF DESCRIPTION OF THE SEVERAL VIEWS OF THE DRAWING

The present invention will now be described, by way of example with reference to the accompanying drawings, in which.

Figure 1:
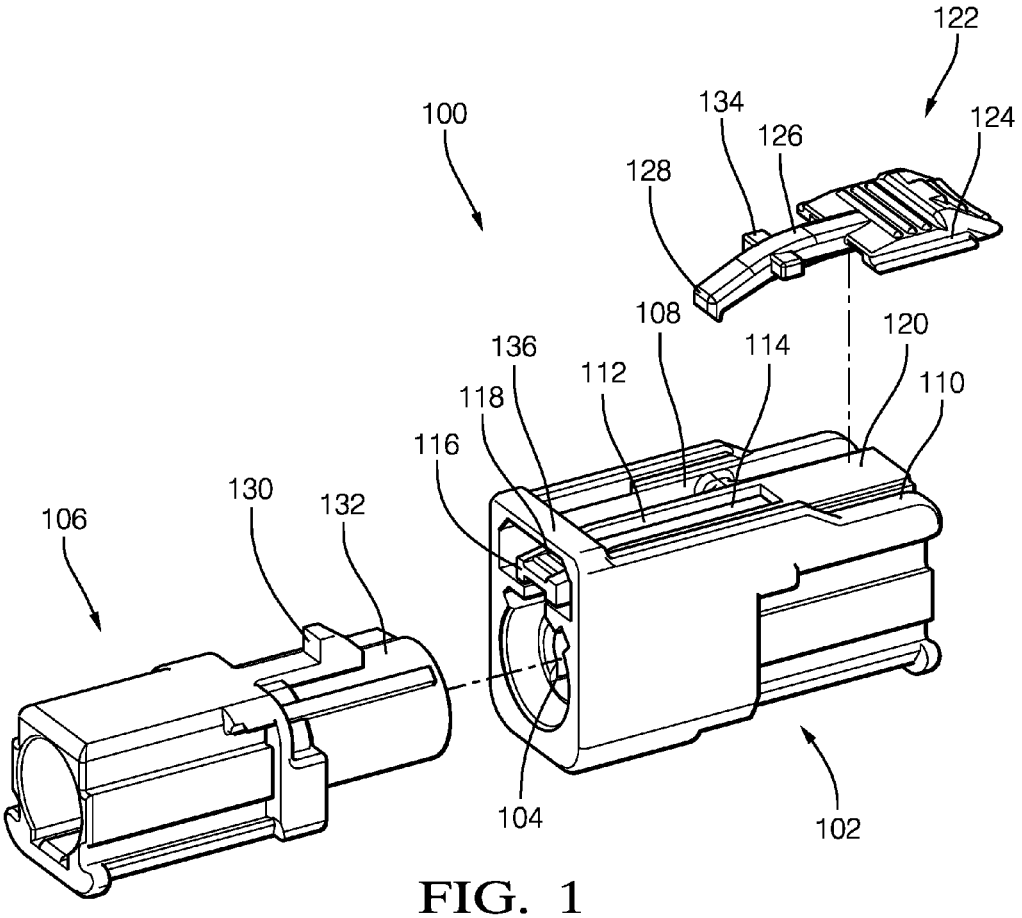
FIG. 1 is an exploded perspective view of a connector assembly of FIG. 1 in accordance with a first embodiment.

Similar features of the embodiments illustrated in the drawings share the last two reference numbers.

DETAILED DESCRIPTION OF THE INVENTION

The connector assembly described herein includes a primary locking system made up of a primary latch and primary striker that, when engaged, inhibit the first and second connectors of the connector assembly from being inadvertently separated. The connector assembly further includes a connector position assurance (CPA) device that is essentially a secondary locking system. The CPA device is designed so that it can be moved from an initial position to a final position that inhibits disengagement of the primary locking system. The CPA further verifies that the first and second connectors of the connector assembly are fully mated, since it cannot be moved to the final position until they are fully mated. The CPA device described herein includes a feature that prevents the CPA device from being moved to the final position before the first and second connectors are fully mated, thus solving the problem described in the Background of the Invention section of this specification.

In the following description, orientation terms such as "longitudinal" will refer to the mating axis X while "lateral" refers to an axis perpendicular to the mating axis, which is not necessarily the transverse axis. Furthermore, terms relating to "top" "bottom", "upper", and "lower" are to be understood relative to an axis perpendicular to the mating axis X, which is not necessarily the vertical axis. As used herein the terms "front" and "forward" refer to a lateral orientation from the first connector towards the second connector and the terms "back", "rear", "rearward", and "behind" refer to a lateral orientation oriented from the second connector towards the first connector.

A first non-limiting example of the connector assembly 100 is shown in FIGS. 1-4B. As illustrated in FIG. 1, the connector assembly 100 includes a first connector 102 that defines a cavity 104 within. The first connector 102 is configured to receive a corresponding second connector 106 within the cavity 104 when the first connector 102 is mated to the second connector 106. The connector assembly 100 illustrated here is an electrical connector configured to join shielded electrical wires, such as those used for an antenna. The first and second connectors 102, 106 each contain electrical terminals (not shown) attached to electrical wires (not shown) that are designed to interface and connect with corresponding terminals (not shown) in the corresponding connector. The terminals are in straight configuration. This connector conforms to USCAR-18 standards. While the connector assembly 100 illustrated here is constructed to interconnect a single shielded wire cable, alternative embodiments of the connector assembly may connect a plurality of wire cables. Other alternative embodiments of the connector assembly may be used to interconnect other types of conductors, such as fiber optic cables, fluid carrying lines, pneumatic tubing, or a combination of any of these.

The connector assembly 100 includes a primary locking lever 108 that is pivotably mounted to a top surface 110 of the first connector 102. The primary locking lever 108 is elastically hinged to the top surface 110 of the first connector 102. The primary locking lever 108 includes a pair of beams 112 extending along the mating axis X and generally parallel to one another. The pair of beams 112 define a slit 114 between them.

The primary locking lever 108 further includes a primary latch 116 that mounted to the forward portion of the pair of beams 112. The rearward edge of the primary latch 116 defines a lateral ridge on the upper surface of the primary latch 116 that provides secondary striker 118. In order to lift up the primary latch 116, the primary locking lever 108 comprises a lifting lever 120 having a front end fixed to the pair of beams 112, and a release button on the opposing end of the lifting lever 120. The lifting lever 120 comprises a pivot lug (not shown) intended to cooperate with the top surface 110 of the first connector 102, when the first and second connectors 102, 106 are 102, 106 mated. In this way, the primary latch 116 can only be lifted up when the first and second connectors 102, 106 are mated.

Figure 2:
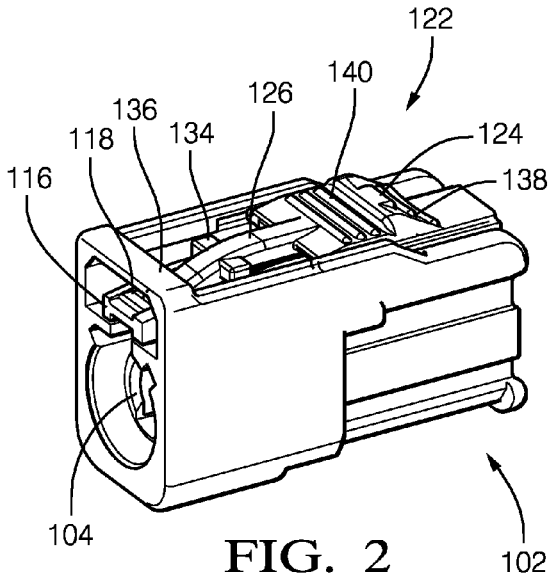
FIG. 2 is a perspective view of a first connector of the connector assembly of FIG. 1 in accordance with the first embodiment.
Figure 3:
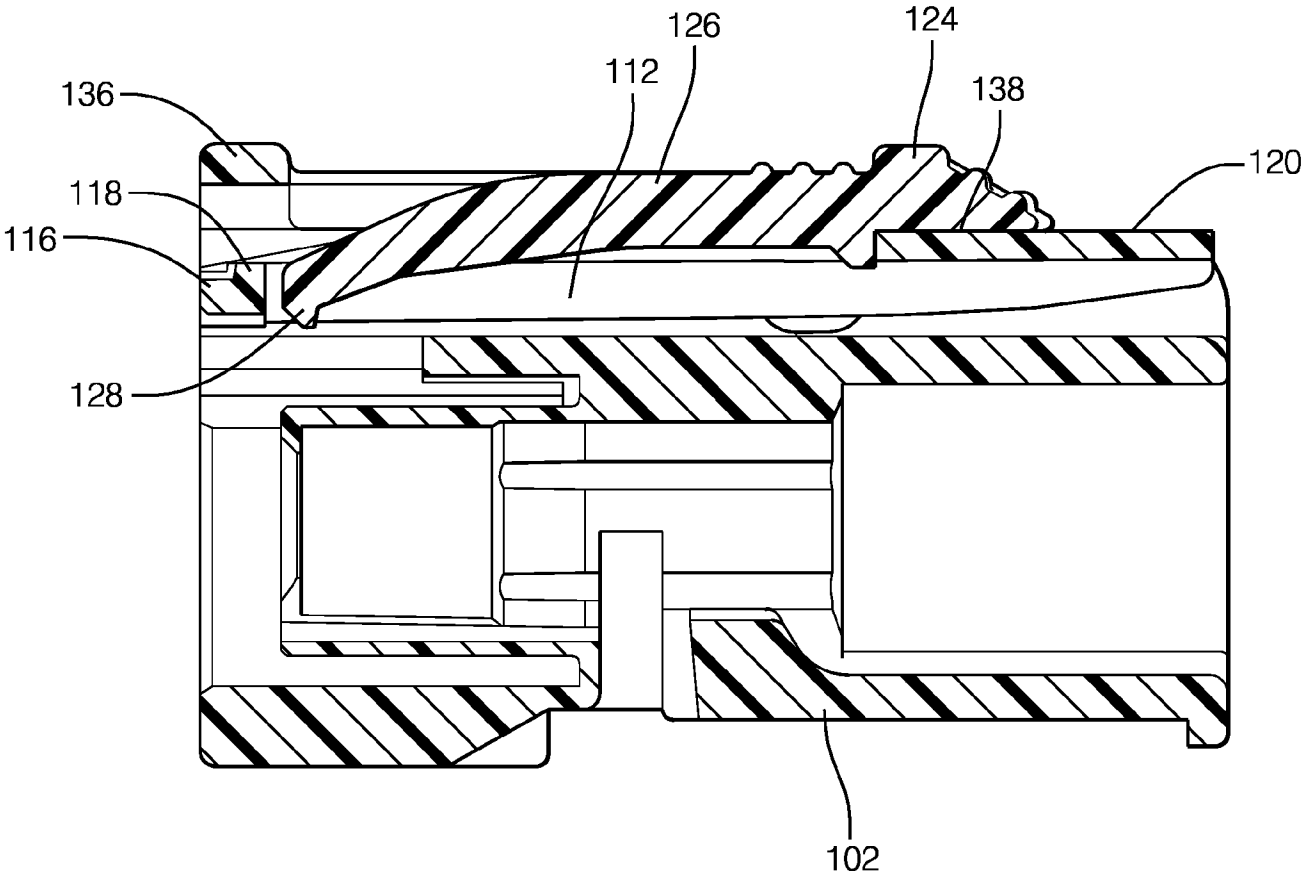
FIG. 3 is a cross section view of the connector assembly of FIG. 1 with a connector position assurance (CPA) device is an initial position in accordance with the first embodiment.
Figure 4B:
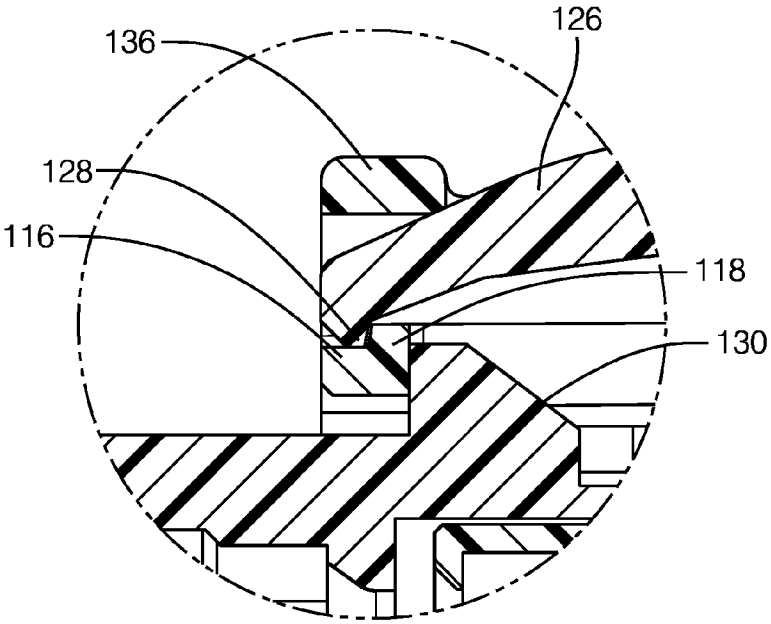
FIG. 4B is a close up cross section view of the connector assembly of FIG. 1 with a connector position assurance (CPA) device is a final position in accordance with the first embodiment.
Figure 4A:
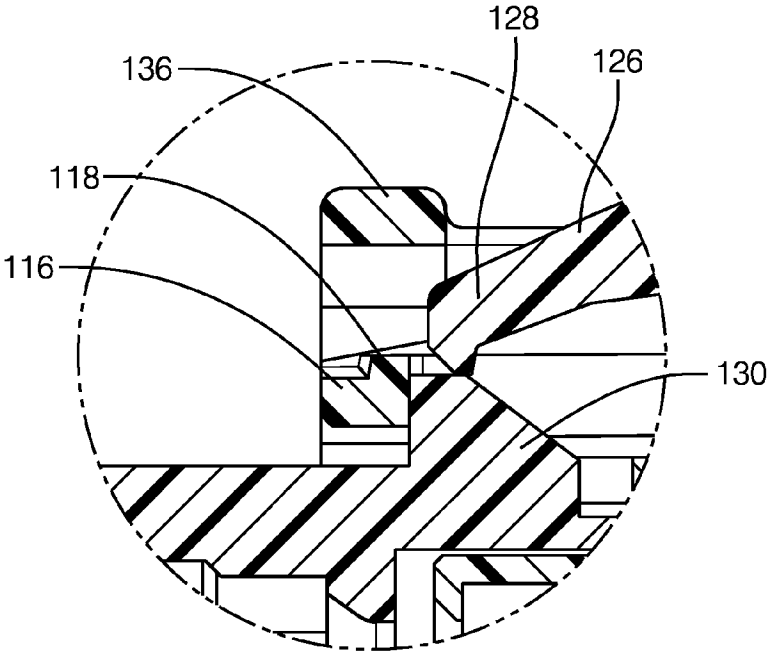
FIG. 4A is a close up cross section view of the connector assembly of FIG. 1 with a connector position assurance (CPA) device is an intermediate position in accordance with the first embodiment.

The connector assembly 100 further includes a connector position assurance (CPA) device 122 that is movable from an initial position as shown in FIGS. 3 and 4A to a final position as shown in FIG. 4B. As best illustrated in FIG. 2, the CPA device 122 has a base 124 that is slideably mounted to the first connector 102, and a CPA lever 126 attached at one end to the base 124. The CPA lever 126 defines a secondary latch 128 at a free end of the CPA lever 126. The CPA lever 126 may be characterized as a cantilever beam.

Referring again to FIG. 1, the second connector 106 includes a primary striker 130 fixed to the top surface 132 of the second connector 106. The primary striker 130 has a locking rear end that defines a striker surface that engages the primary latch 116 and a sloped front end defining a ramp surface. The primary striker 130 also has a top striker surface between the locking rear end and the sloped front end.

The operation of a locking system of the connector assembly 100 will now be described.

When the CPA device 122 is in the initial position as shown in FIG. 3, and when the first and second connectors 102, 106 are unmated, the CPA lever 126 is located in the slit 114 between the pair of beams 112. The secondary latch 128 of the CPA lever 126 is blocked by the lateral ridge of the secondary striker 118 on the primary latch 116 that is forward of the secondary latch 128 such that the CPA device 122 cannot move towards its final position.

As the first and second connectors 102, 106 are mated, the primary latch 116 of the primary locking lever 108 contacts the sloped front end of the primary striker 130. The primary locking lever 108 pivots as it is deflected by the primary latch 116 riding up in the sloped front end of the primary striker 130 and the top striker surface of the primary striker 130. As the first connector 102 and second connector 106 are further mated, the primary latch 116 clears the top striker surface of the primary striker 130 and the primary locking lever 108 pivots back to its original orientation, engaging the primary latch 116 with the locking rear end of the primary striker 130, thus locking the first connector 102 to the secondary connector as shown in FIG. 4A.

As the primary latch 116 slides over the primary striker 130, the CPA lever 126 is deflected out of the slit 114 as the secondary striker 118 also rides up the sloped front end of the primary striker 130. When the first connector 102 is fully mated with the second connector 106, the secondary latch 128 is out of the slit 114 and resting atop a top latch surface of the primary latch 116. Since the primary latch 116 is now engaged with the primary striker 130 and, in its original orientation, the primary latch 116 is no longer blocking the secondary latch 128 and the CPA device 122 may be moved forward from the initial position shown in FIG. 4A to the final position shown in FIG. 4B.

The CPA lever 126 includes a lateral lever flange 134 that extends laterally from each side of the CPA lever 126. This lever flange 134 is configured so that the CPA lever 126 can only be deflected from the slit 114 in one direction, in this example, upward out of the slit 114 so that the secondary latch 128 is no longer blocked by the primary latch 116. The lever flange 134 is configured to contact the pair of beams 112, so that the CPA lever 126 is prevented from being deflected downward out of the slit 114. If the CPA lever 126 were deflected downward out of the slit 114, the secondary latch 128 could "submarine" or move forward of the primary latch 116 before the primary latch 116 is engaged with the secondary latch 128 and allow the CPA device 122 to be moved from the initial position before the first and second connectors 102, 106 are fully mated.

As the CPA device 122 moves forward from the initial position to the final position, the secondary latch 128 rides over the lateral ridge until it clears the lateral ridge and deflects downwardly, thus engaging the secondary striker 118.

The base 124 of the CPA device 122 further comprises two lateral guiding flanges on each side. Each lateral guiding flange is slideably mounted in a respective lateral guiding groove provided in the first connector 102, so as to guide the CPA device 122 form the initial position to the final position.

As shown in FIG. 4B, the CPA lever 126 engages a wall 136 defined by the first connector 102 that is spaced apart from the top surface 110 when the CPA device 122 is in the final position. Consequently, the primary locking lever 108 can no longer pivot if the release button of the lifting lever 120 is actuated, thereby preventing the primary latch 116 and primary striker 130 from disengaging which would result in an unintentional unmating of the first and second connectors 102, 106.

The CPA device 122 is prevented from going back unintentionally from the final position to the initial position, by the secondary latch 128 of the CPA lever 126 being hook-shaped and stopped by the secondary striker 118.

In the above-described embodiments, the CPA device 122 is manually movable from its initial position to its final position in the same direction as the mating direction, which is particularly suitable from the ergonomic standpoint.

As seen in FIGS. 1 and 2 the base 124 of the CPA device 122 has a generally trapezoidal prism shape with a trapezoidal forward surface and a trapezoidal rearward surface. The rearward surface of the base 124 has a first plurality of lateral protrusions or ridges that provide a push surface 138 used by the operator to push the CPA device 122 from the initial position to the final position. The forward surface of the base 124 defines a second plurality of lateral protrusions or ridges that provide a pull surface 140 used by the operator to pull the CPA device 122 from the final position to the initial position. The base 124 does not extend beyond the wall 136, thereby providing a low profile CPA device 122.

Figure 5:
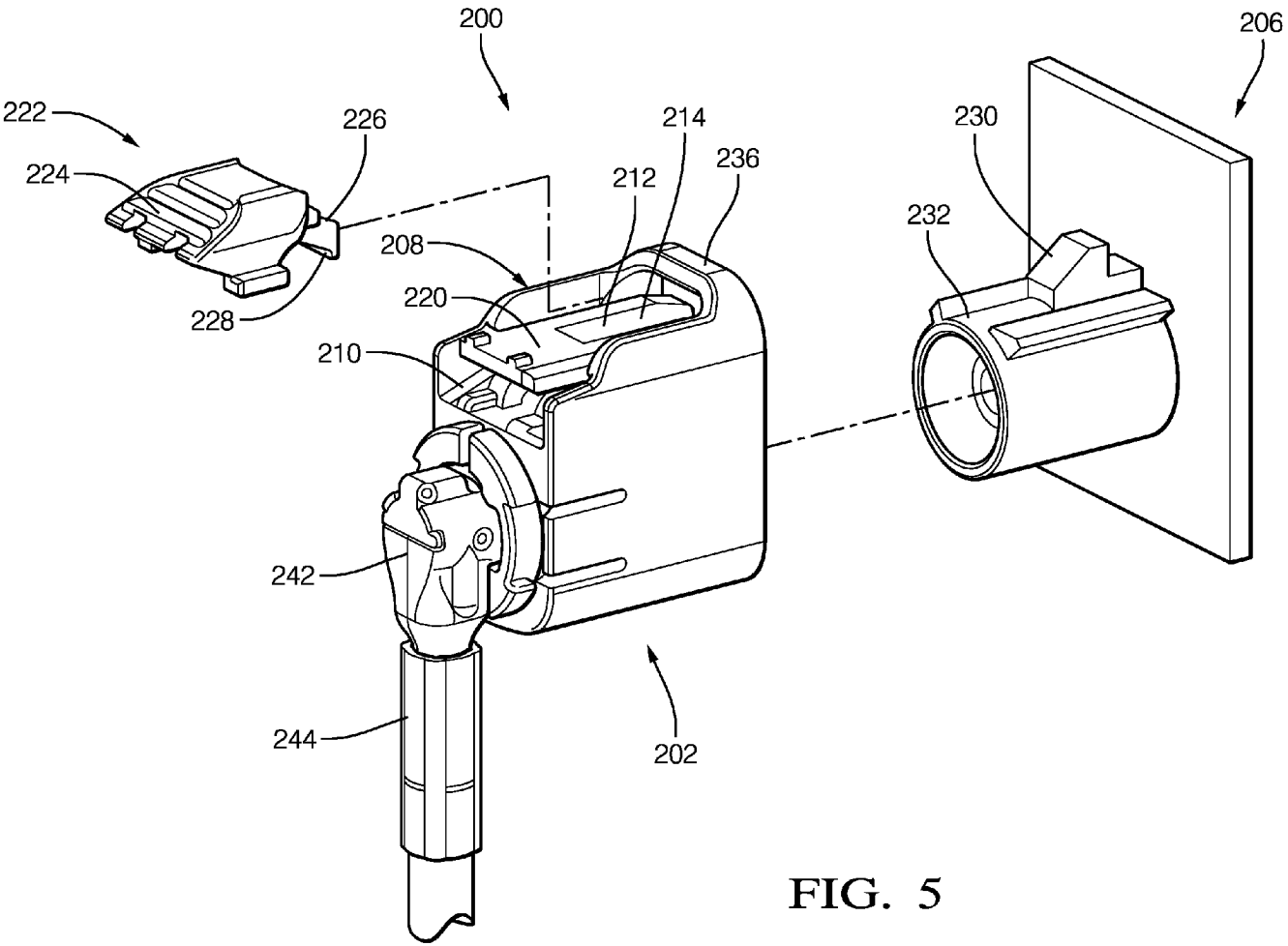
FIG. 5 is an exploded perspective view of a connector assembly of FIG. 1 in accordance with a second embodiment.

A second non-limiting example of the connector assembly 200 is shown in FIGS. 5-9. As illustrated in FIG. 5, the connector assembly 200 includes a first connector 202 that defines a cavity 204 within. The first connector 202 is configured to receive a corresponding second connector 206 within the cavity 204 when the first connector 202 is mated to the second connector 206. The connector assembly 200 illustrated here is an electrical connector configured to join shielded electrical wires, such as those used for an antenna. The first and second connectors 202, 206 each contain an electrical terminal 242 attached to a shielded wire cable 244 that is designed to interface and connect with corresponding terminals (not shown) in the corresponding connector. The terminals are in right-angled configuration. This connector conforms to USCAR-18 standards.

The connector assembly 200 includes a primary locking lever 208 that is pivotably mounted to a top surface 210 of the first connector 202. The primary locking lever 208 is elastically hinged to the top surface 210 of the first connector 202. The primary locking lever 208 includes a pair of beams 212 extending along the mating axis X and generally parallel to one another. The pair of beams 212 define a slit 214 between them.

The primary locking lever 208 further includes a primary latch 216 that mounted to the forward portion of the pair of beams 212. The rearward edge of the primary latch 216 defines a lateral ridge on the upper surface of the primary latch 216 that provides secondary striker 218. In order to lift up the primary latch 216, the primary locking lever 208 comprises a lifting lever 220 having a front end fixed to the pair of beams 212, and a release button on the opposing end of the lifting lever 220. The lifting lever 220 comprises a pivot lug (not shown) intended to cooperate with the top surface 210 of the first connector 202, when the first and second connectors 202, 206 are mated. In this way, the primary latch 216 can only be lifted up when the first and second connectors 202, 206 are mated.

Figure 6:
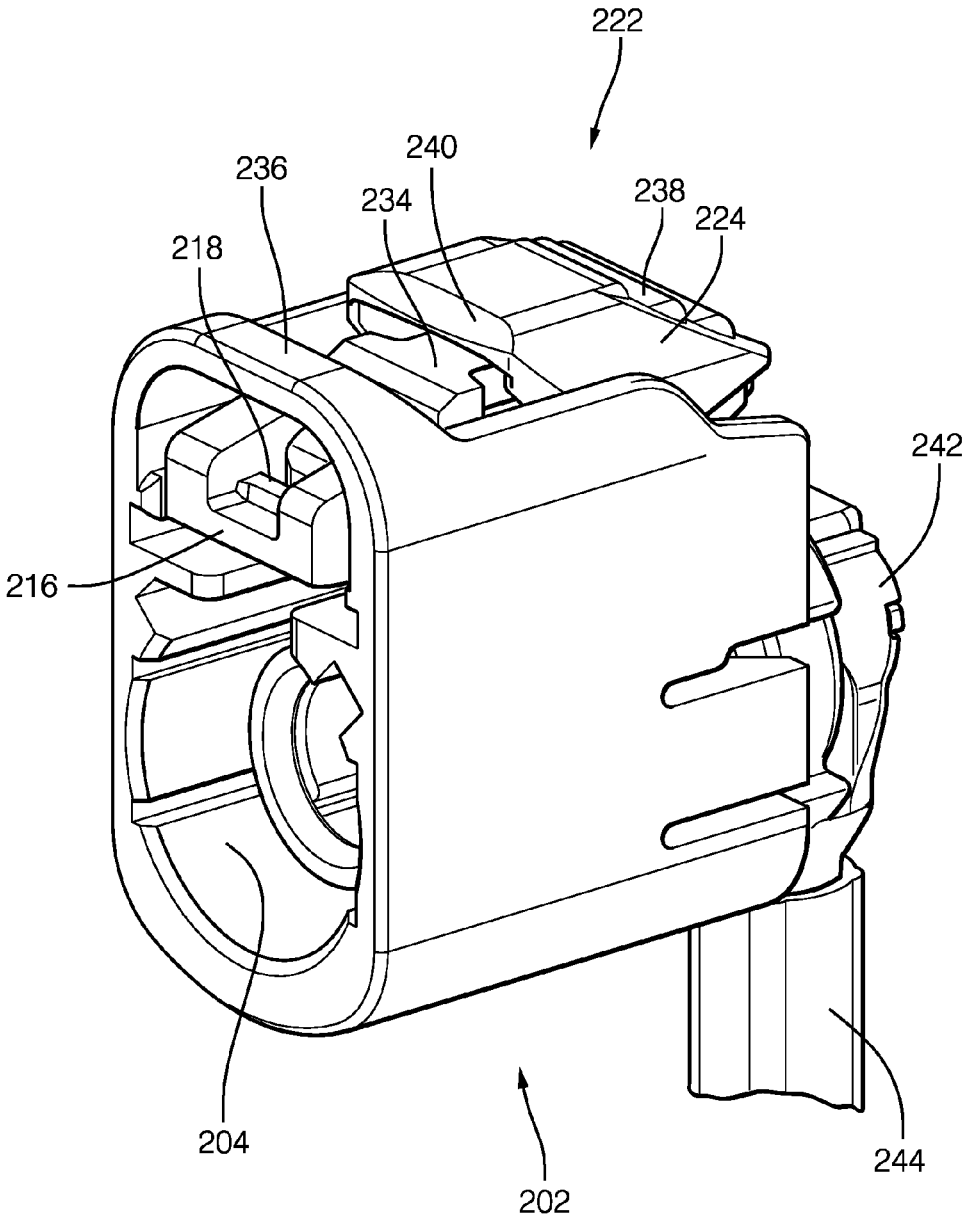
FIG. 6 is a perspective view of a first connector of the connector assembly of FIG. 5 in accordance with the second embodiment.
Figure 7:
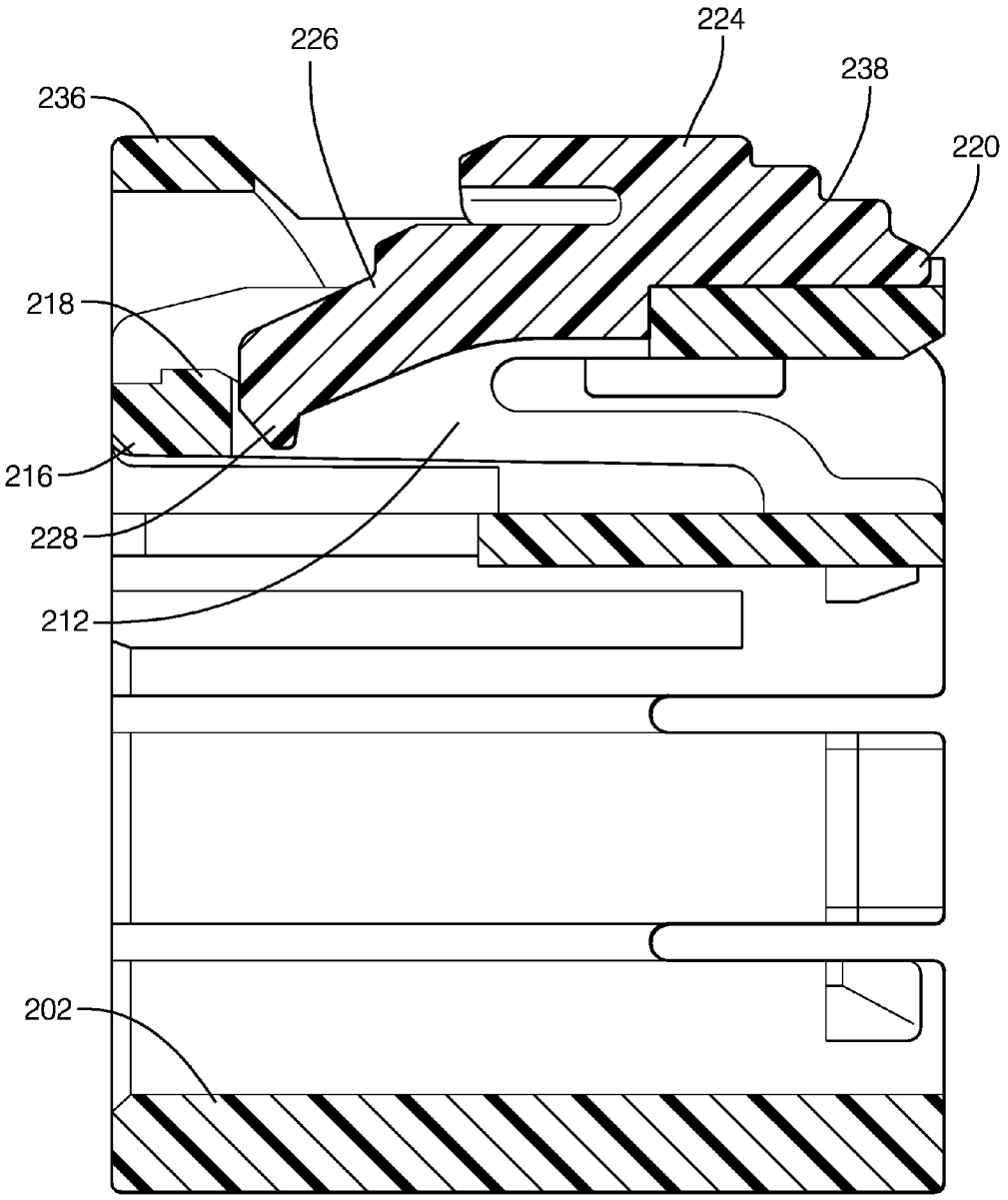
FIG. 7 is a cross section view of the connector assembly of FIG. 5 with a connector position assurance (CPA) device is an initial position in accordance with the second embodiment.
Figure 8B:
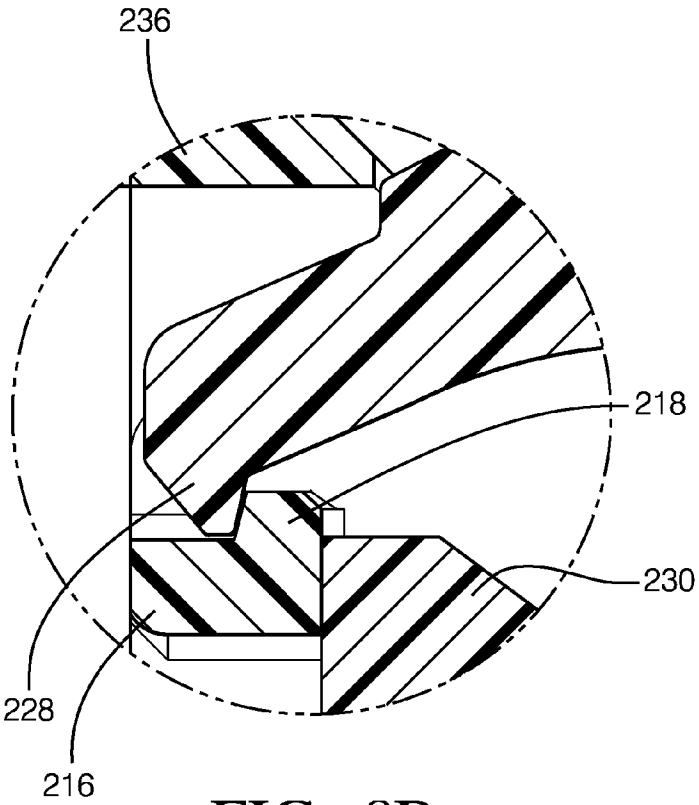
FIG. 8B is a close up cross section view of the connector assembly of FIG. 5 with a connector position assurance (CPA) device is a final position in accordance with the second embodiment.
Figure 8A:
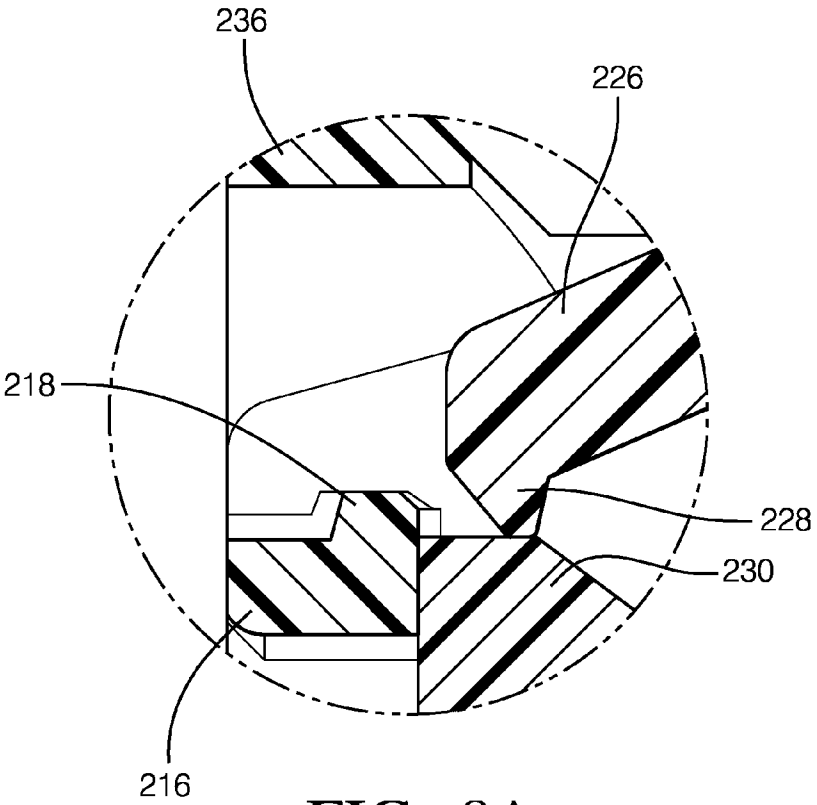
FIG. 8A is a close up cross section view of the connector assembly of FIG. 5 with a connector position assurance (CPA) device is an intermediate position in accordance with the second embodiment.

The connector assembly 200 further includes a connector position assurance (CPA) device 222 that is movable from an initial position as shown in FIGS. 7 and 8A to a final position as shown in FIG. 8B. As best illustrated in FIG. 6, the CPA device 222 has a base 224 that is slideably mounted to the first connector 202, and a CPA lever 226 attached at one end to the base 224. The CPA lever 226 defines a secondary latch 228 at a free end of the CPA lever 226. The CPA lever 226 may be characterized as a cantilever beam. The CPA lever 226 is shorter than CPA lever 126.

Referring again to FIG. 5, the second connector 206 includes a primary striker 230 fixed to the top surface 232 of the second connector 206. The primary striker 230 has a locking rear end that defines a striker surface that engages the primary latch 216 and a sloped front end defining a ramp surface. The primary striker 230 also has a top striker surface between the locking rear end and the sloped front end.

The operation of a locking system of the connector assembly 200 will now be described.

When the CPA device 222 is in the initial position as shown in FIG. 7, and when the first and second connectors 202, 206 are unmated, the CPA lever 226 is located in the slit 214 between the pair of beams 212. The secondary latch 228 of the CPA lever 226 is blocked by the lateral ridge of the secondary striker 218 on the primary latch 216 that is forward of the secondary latch 228 such that the CPA device 222 cannot move towards its final position.

As the first and second connectors 202, 206 are mated, the primary latch 216 of the primary locking lever 208 contacts the sloped front end of the primary striker 230. The primary locking lever 208 pivots as it is deflected by the primary latch 216 riding up in the sloped front end of the primary striker 230 and the top striker surface of the primary striker 230. As the first connector 202 and second connector 206 are further mated, the primary latch 216 clears the top striker surface of the primary striker 230 and the primary locking lever 208 pivots back to its original orientation, engaging the primary latch 216 with the locking rear end of the primary striker 230, thus locking the first connector 202 to the secondary connector as shown in FIG. 8A.

As the primary latch 216 slides over the primary striker 230, the CPA lever 226 is deflected out of the slit 214 as the secondary striker 218 also rides up the sloped front end of the primary striker 230. When the first connector 202 is fully mated with the second connector 206, the secondary latch 228 is out of the slit 214 and resting atop a top latch surface of the primary latch 216. Since the primary latch 216 is now engaged with the primary striker 230 and, in its original orientation, the primary latch 216 is no longer blocking the secondary latch 228 and the CPA device 222 may be moved forward from the initial position shown in FIG. 8A to the final position shown in FIG. 8B.

The CPA lever 226 includes a lateral lever flange 234 that extends laterally from each side of the CPA lever 226. This lever flange 234 is configured so that the CPA lever 226 can only be deflected from the slit 214 in one direction, in this example, upward out of the slit 214 so that the secondary latch 228 is no longer blocked by the primary latch 216. The lever flange 234 is configured to contact the pair of beams 212, so that the CPA lever 226 is prevented from being deflected downward out of the slit 214. If the CPA lever 226 were deflected downward out of the slit 214, the secondary latch 228 could "submarine" or move forward of the primary latch 216 before the primary latch 216 is engaged with the secondary latch 228 and allow the CPA device 222 to be moved from the initial position before the first and second connectors 202, 206 are fully mated.

As the CPA device 222 moves forward from the initial position to the final position, the secondary latch 228 rides over the lateral ridge until it clears the lateral ridge and deflects downwardly, thus engaging the secondary striker 218.

The base 224 of the CPA device 222 further comprises two lateral guiding flanges on each side. Each lateral guiding flange is slideably mounted in a respective lateral guiding groove provided in the first connector 202, so as to guide the CPA device 222 form the initial position to the final position.

As shown in FIG. 8B, the CPA lever 226 engages a wall 236 defined by the first connector 202 that is spaced apart from the top surface 210 when the CPA device 222 is in the final position. Consequently, the primary locking lever 208 can no longer pivot if the release button of the lifting lever 220 is actuated, thereby preventing the primary latch 216 and primary striker 230 from disengaging which would result in an unintentional unmating of the first and second connectors 202, 206.

The CPA device 222 is prevented from going back unintentionally from the final position to the initial position, by the secondary latch 228 of the CPA lever 226 being hook-shaped and stopped by the secondary striker 218.

In the above-described embodiments, the CPA device 222 is manually movable from its initial position to its final position in the same direction as the mating direction, which is particularly suitable from the ergonomic standpoint.

As seen in FIGS. 5 and 6 the base 224 of the CPA device 222 has a generally trapezoidal prism shape with a trapezoidal forward surface and a trapezoidal rearward surface. The rearward surface of the base 224 has a plurality of lateral protrusions or ridges that provide a push surface 238 used by the operator to push the CPA device 222 from the initial position to the final position. The forward surface of the base 224 defines an arcuate concave indentation that provide a pull surface 240 used by the operator to pull the CPA device 222 from the final position to the initial position. The base 224 does not extend beyond the wall 236, thereby providing a low profile CPA device 222. The push surface 240 may also be used to the actuate the lifting lever 220 when the first connector 202 is mated to the second connector 206 since the CPA device 222 is held in the initial position until the first and second connectors 202, 206 are mated.

Figure 9:
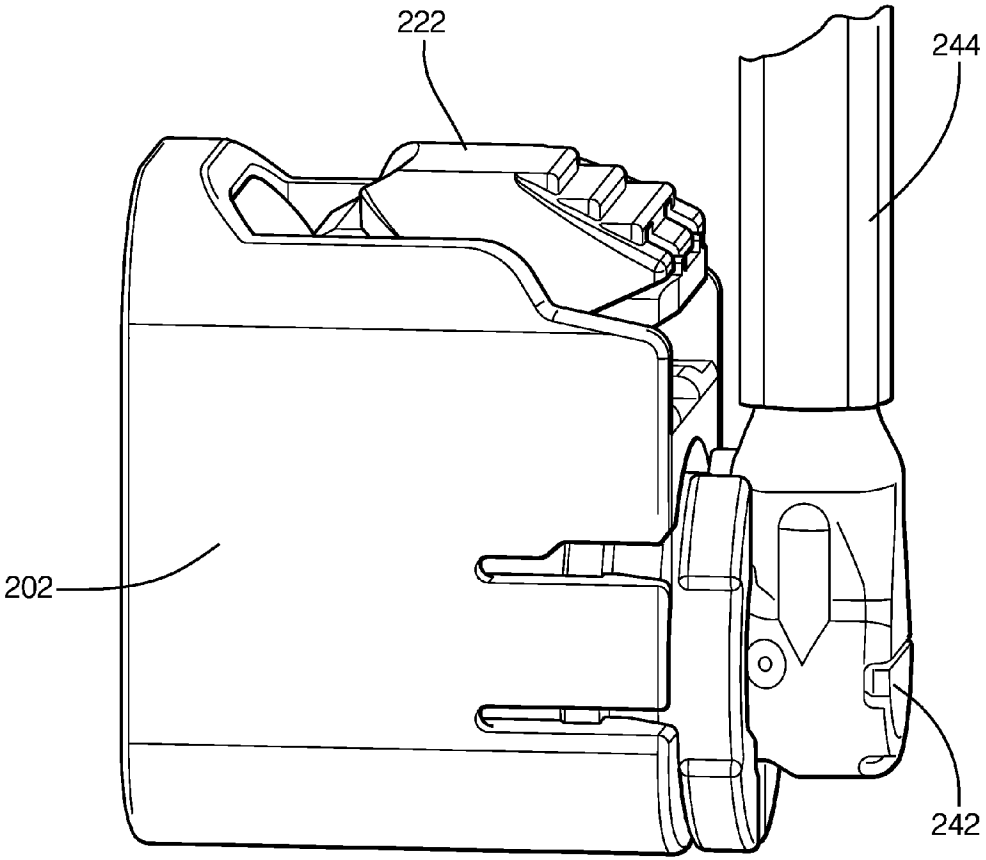
FIG. 9 is a side view of the connector assembly of FIG. 5 with a cable rotated to a 12 o'clock position in accordance with the second embodiment.

As illustrated in FIG. 9, the base 224 does not contact the shielded wire cable 244 when the CPA device 222 is in the initial position regardless of a rotational orientation of the electrical terminal 242 and the shielded wire cable 244 relative to the first connector, even in the worst case orientation, as illustrated here with the electrical terminal 242 and the shielded wire cable 244 in a 12 o'clock position.

Accordingly a connector system having a low profile connector position assurance device is provided. The low profile CPA device does not project beyond the walls of the connector assembly and can meet USCAR-18 standards and automotive OEM ergonomic standards.

While this invention has been described in terms of the preferred embodiments thereof, it is not intended to be so limited, but rather only to the extent set forth in the claims that follow. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely prototypical embodiments.

Many other embodiments and modifications within the spirit and scope of the claims will be apparent to those of skill in the art upon reviewing the above description. The scope of the invention should, therefore, be determined with reference to the following claims, along with the full scope of equivalents to which such claims are entitled.

In the following claims, the terms "including" and "in which" are used as the plain-English equivalents of the respective terms "comprising" and "wherein." Moreover, the use of the terms first, second, etc. does not denote any order of importance, but rather the terms first, second, etc. are used to distinguish one element from another. Furthermore, the use of the terms a, an, etc. do not denote a limitation of quantity, but rather denote the presence of at least one of the referenced items. Additionally, directional terms such as upper, lower, etc. do not denote any particular orientation, but rather the terms upper, lower, etc. are used to distinguish one element from another and locational establish a relationship between the various elements.

Further, the limitations of the following claims are not written in means-plus-function format and are not intended to be interpreted based on 35 USC §112(f), unless and until such claim limitations expressly use the phrase "means for" followed by a statement of function void of further structure.

We claim:

1. A connector assembly, comprising:

a first connector having a primary locking lever pivotably mounted to the first connector, said primary locking lever defining a pair of beams extending generally parallel to one another along a mating axis to a primary latch mounted to the pair of beams, wherein the primary latch defines a lateral ridge along a rearward edge providing a secondary striker; and a second connector configured to mate with the first connector along the mating axis having a primary striker configured to engage the primary latch so as to lock the first connector and the second connector together when the first connector and the second connector are mated; and a connector position assurance (CPA) device movable from an initial position to a final position only when the first connector and the second connector are mated, said CPA device having, a base slideably mounted to the first connector, and a CPA lever defining a secondary latch extending from the base, wherein the secondary latch engages said lateral ridge to inhibit movement of the CPA device from the initial position to the final position until after the first connector and the second connector are mated and wherein the secondary latch of the CPA device is configured to engage the secondary striker when the CPA device is in the final position, thereby preventing disengagement of the primary latch from the primary striker.

2. The connector assembly of claim 1, wherein the pair of beams defines a slit therebetween and wherein the CPA lever is at least partially disposed within said slit.

3. The connector assembly of claim 2, wherein the CPA lever defines a lateral flange extending laterally on each side of the CPA lever and configured to engage said pair of beams, thereby maintaining engagement of the secondary latch with the lateral ridge until the first connector and the second connector are mated.

4. The connector assembly of claim 3, wherein the secondary latch of the CPA device is intermediate the secondary striker and a wall of the first connector when the CPA device is in the final position, thereby inhibiting vertical movement of the secondary latch and inhibiting release of the primary latch from the primary striker.

5. The connector assembly of claim 4, wherein the wall is spaced apart from the first connector.

6. The connector assembly of claim 4, wherein the base does not extend beyond said wall.

7. The connector assembly of claim 1, wherein the base of the CPA device is characterized has having a generally trapezoidal prism shape with a trapezoidal forward surface and a trapezoidal rearward surface.

8. The connector assembly of claim 7, wherein the rearward surface of the base defines a first plurality of lateral protrusions providing a push surface configured for moving the CPA device from the initial position to the final position.

9. The connector assembly of claim 8, wherein the forward surface of the base defines a second plurality of lateral protrusions providing a pull surface configured for moving the CPA device from the final position to the initial position.

10. The connector assembly of claim 8, wherein the forward surface of the base defines an indentation providing pull surface configured for moving the CPA device from the final position to the initial position.

11. The connector assembly of claim 1, wherein the first connector and the second connector conform to USCAR-18 standards.

12. The connector assembly of claim 1, wherein an electrical terminal disposed within the first connector and an electrical wire cable attached to said electrical terminal have a straight orientation between them.

13. The connector assembly of claim 1, wherein an electrical terminal disposed within the first connector and an electrical wire cable attached to said electrical terminal have a right-angled orientation between them.

14. The connector assembly of claim 13, wherein the base does not contact the electrical wire cable when the CPA device is in the initial position regardless of a rotational orientation of the electrical wire cable relative to the first connector.

* * * * *